US010534314B1

(12) United States Patent
Stafford et al.

(10) Patent No.: US 10,534,314 B1
(45) Date of Patent: Jan. 14, 2020

(54) ELECTROSTATIC PROCESS UNIT FAN IMPELLER AND COOLING DUCT

(71) Applicant: Toshiba TEC Kabushiki Kaisha, Shinagawa-ku (JP)

(72) Inventors: Don W. Stafford, Lexington, KY (US); Donn D. Bryant, Lexington, KY (US)

(73) Assignee: Toshiba TEC Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 16/171,877

(22) Filed: Oct. 26, 2018

(51) Int. Cl.

| | |
|---|---|
| ***G03G 21/20*** | (2006.01) |
| ***G03G 21/16*** | (2006.01) |
| ***G03G 15/08*** | (2006.01) |
| ***B41J 29/377*** | (2006.01) |

(52) U.S. Cl.
CPC ..... *G03G 21/206* (2013.01); *B41J 29/377* (2013.01); *G03G 15/0812* (2013.01); *G03G 21/1652* (2013.01); *G03G 2215/025* (2013.01); *G03G 2215/0822* (2013.01); *G03G 2215/0827* (2013.01); *G03G 2221/1645* (2013.01)

(58) Field of Classification Search
CPC ..... G03G 15/0812; G03G 21/206; G03G 2221/1645; G03G 2221/18
USPC ..... 399/91, 92, 98–101, 107, 110, 111
See application file for complete search history.

(56) References Cited

U.S. PATENT DOCUMENTS

| | | | | |
|---|---|---|---|---|
| 7,046,940 | B2 * | 5/2006 | Kim | G03G 15/0817 399/98 |
| 8,538,286 | B2 | 9/2013 | Brown et al. | |
| 9,158,272 | B2 | 10/2015 | Okabe | |
| 9,176,464 | B2 * | 11/2015 | Kwon | G03G 21/18 |

FOREIGN PATENT DOCUMENTS

| | | |
|---|---|---|
| JP | 2002278211 | 9/2002 |

* cited by examiner

*Primary Examiner* — Hoan H Tran
(74) *Attorney, Agent, or Firm* — Ulmer & Berne LLP

(57) ABSTRACT

A system and method for cooling electrostatic process units includes an impeller in communication with a shaft associated with a rotating component of the electrostatic process unit such as a toner mixer, a waste auger, a developer, or a photoconductive drum. When the shaft rotates, the impeller rotates and causes air to be directed into a cooling duct. The cooling duct directs the air over one or more components of the electrostatic process unit such as the developer or a doctor blade. The air directed over the components cools the electrostatic process unit.

18 Claims, 5 Drawing Sheets

ELECTROSTATIC PROCESS UNIT FAN IMPELLER AND COOLING DUCT

TECHNICAL FIELD

This application relates generally to a fan and cooling duct for an electrostatic process unit (EPU), and more particularly to a fan impeller secured to a rotating EPU shaft and an associated cooling duct for cooling EPU components.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

An electrostatic process unit (EPU) in many toner-based printers and multifunction peripherals performs the printing function. The EPU typically comprises a photoconductive drum, and a developer roller, and can include a charge unit, a toner hopper, a semiconductor laser and developer, among other components as would be known in the art. The EPU can be configured as a field replaceable unit or can be part of a self-contained compact cartridge that includes the toner. Using magnetic and electrostatic forces, the developer roller and the photoconductive drum transfer toner from a toner hopper to a sheet of paper where it is fused by heat to the paper. After the photoconductive drum transfers toner to the paper, a cleaner blade in the EPU removes residual toner and paper dust from the photoconductive drum.

EPUs are disposed inside printers and can become hot during normal operation, both due to the EPU operation itself and due to the operations of other components inside the printer chassis. Excessive heat inside an EPU can degrade the toner present in the EPU. Heat also increases stresses on EPU components which shortens the useful lifespan of EPUs and increases the frequency of maintenance that is required to maintain printers in an operational state.

BRIEF DESCRIPTION OF THE DRAWINGS

Various embodiments will become better understood with regard to the following description, appended claims and accompanying drawings wherein:

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In an example embodiment, an apparatus includes a fan impeller that is coupled to a shaft of a rotating component of an electrostatic process unit. A cooling duct in fluidic communication with the fan impeller directs air from the fan impeller across a portion of the electrostatic process unit to cool components.

In toner-based electro-photographic printers, the electrostatic process unit, or EPU, selectively transfers toner from an associated toner hopper to a transfer belt for printing images and text onto paper in accordance with user print jobs. EPU components can become hot during normal print operations, especially during periods of frequent use. EPUs are disposed inside printers in an enclosed space. As a result EPUs can become overheated both from heat generated by operation of the EPU itself and from heat generated by nearby components in the printer. Excessive heat can degrade toner present in the EPU which can result in lower quality images and other problems. High temperatures also increase stress on EPU components, which can reduce the useful life of the EPU and increase future maintenance needs.

To prevent overheating, printers can reduce printing speeds in order to limit the amount of heat generated by the EPU. Printers also can incorporate additional fans and motors to circulate air and cool components, but that can increase costs and complexity and motors may need to be controlled by a suitable motor controller. Compact printers are especially prone to overheating due to the close proximity of components to one another. However, in compact printers it may be impractical to add dedicated fans and motors to cool components as these fans and motors take up additional space and increase costs.

In an example embodiment, to cool components in an EPU, a fan impeller is coupled to an existing rotating shaft of one of the EPU components. When the shaft rotates, the fan impeller also rotates which forces air into an associated cooling duct that directs the airflow across portions of the EPU to cool components.

Figure 1:
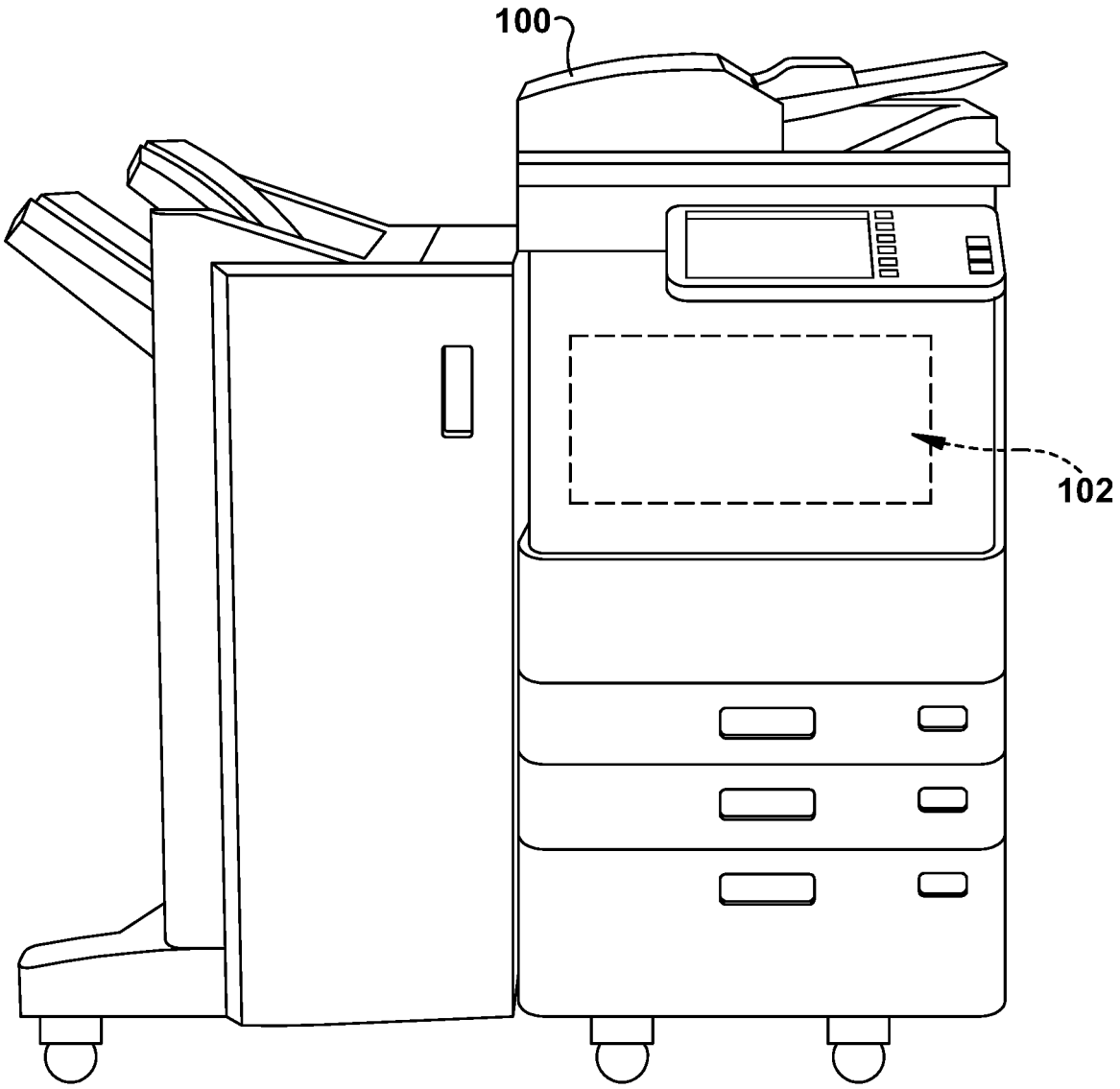
FIG. 1 FIG. 1 is a block diagram of a multifunction peripheral.

With reference to FIG. 1, an example multifunction peripheral (MFP 100) is presented. The MFP 100 includes electrostatic-based, or toner-based, printing hardware 102 for performing printing operations as would be understood in the art.

Figure 2A:
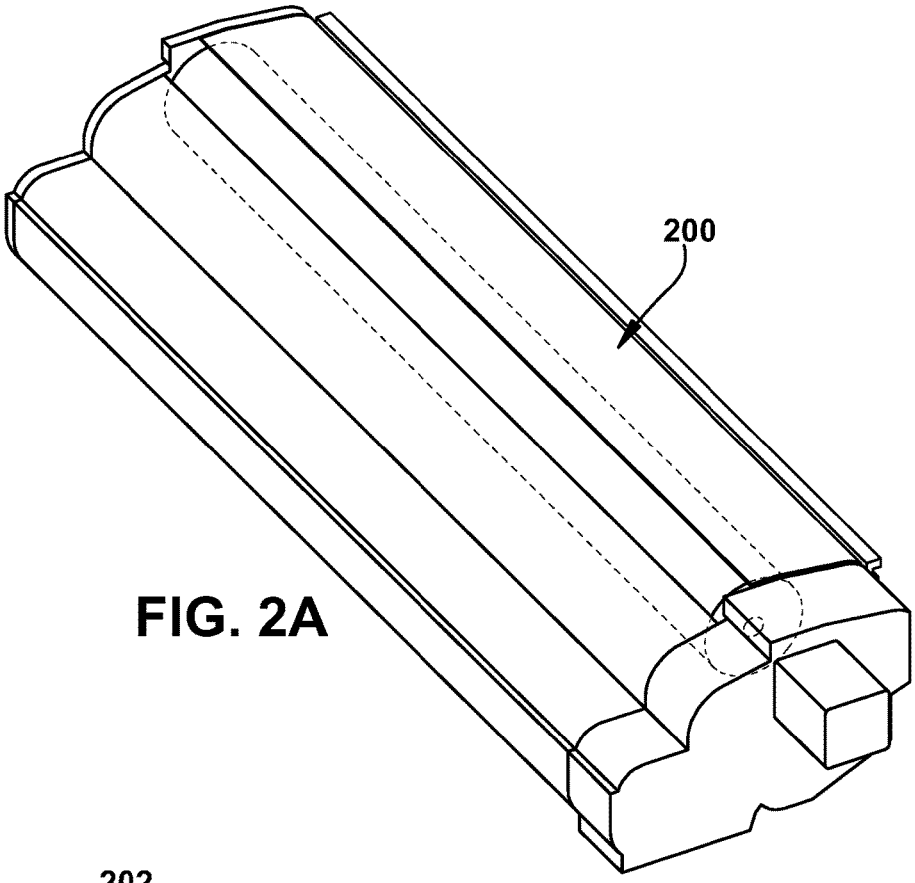
FIG. 2A is a diagram of an example electrostatic process unit.
Figure 2B:
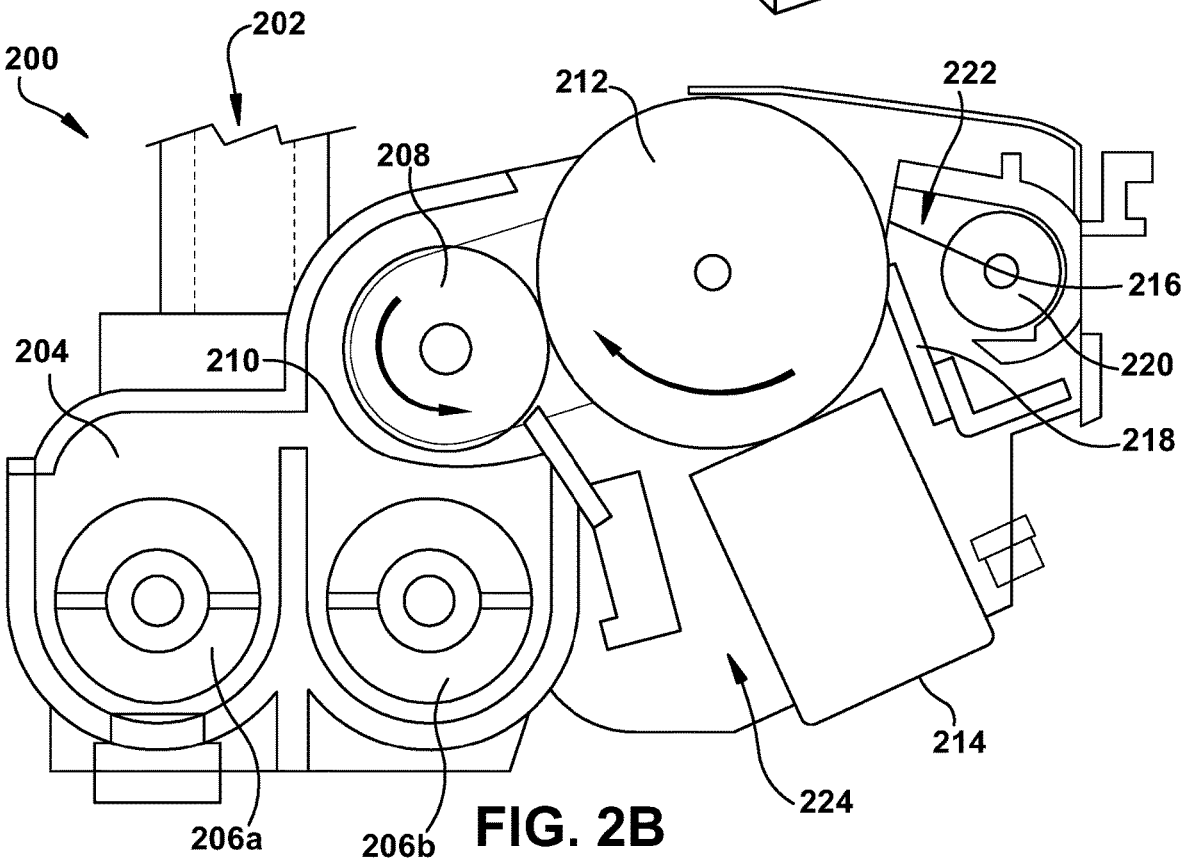
FIG. 2B is a diagram of example components of an electrostatic process unit.

With reference to FIGS. 2A and 2B, diagrams of an electrostatic process unit 200 for a multifunction peripheral are presented. The electrostatic process unit 200 can be a component of the printing hardware 102 of the multifunction peripheral 100 of FIG. 1. The electrostatic process unit 200 receives toner 202 into a toner hopper 204 of a developer unit that includes mixers 206*a* and 206*b*. Toner 202 from the toner hopper 204 is picked up by the developer 208 that rotates towards a doctor blade 210. The doctor blade 210 removes excess toner 202 from the developer 208 leaving a thin evenly distributed layer of toner 202 on the developer 208. The developer 208 rotates towards the photoconductive drum 212. The photoconductive drum 212 is charged by a charger unit 214 which can include a primary charge roller (not shown), and a laser (not shown) associated with the printer produces the image to be printed on the photoconductive drum 212. The high voltages associated with charging and selectively removing charge via a laser cause the electrostatic process unit 200 to develop substantial amounts of heat during use.

As the photoconductive drum 214 rotates, toner 202 on the photoconductive drum 214 is selectively pulled from developer 208 to the photoconductive drum 212 in accordance to the image to print. The photoconductive drum 212 transfers the toner 202 to a transfer belt (not shown) and then to paper (not shown) after which the toner 202 is permanently fused to the paper by a fusing assembly (not shown). After transferring toner 202 to the transfer belt, the photoconductive drum 212 continues to rotate towards a cleaner blade 218 that removes any residual toner and other particles that remain on the photoconductive drum 212. A recovery blade 216 prevents removed toner and other particles from escaping from this section of the developer cavity 222 into other parts of the developer cavity 224. An auger 220 moves waste toner and other particles out of the EPU to a suitable waste receptacle.

Each of the rotatable components of the electrostatic process unit 200, for example the developer 208, the photoconductive drum 214, the mixers 206*a* and 206*b* and the waste auger 220, are mounted on a rotatable shaft. The shafts can be suitably coupled to one another where appropriate or driven by independent motors as would be understood in the art.

Figure 3A:
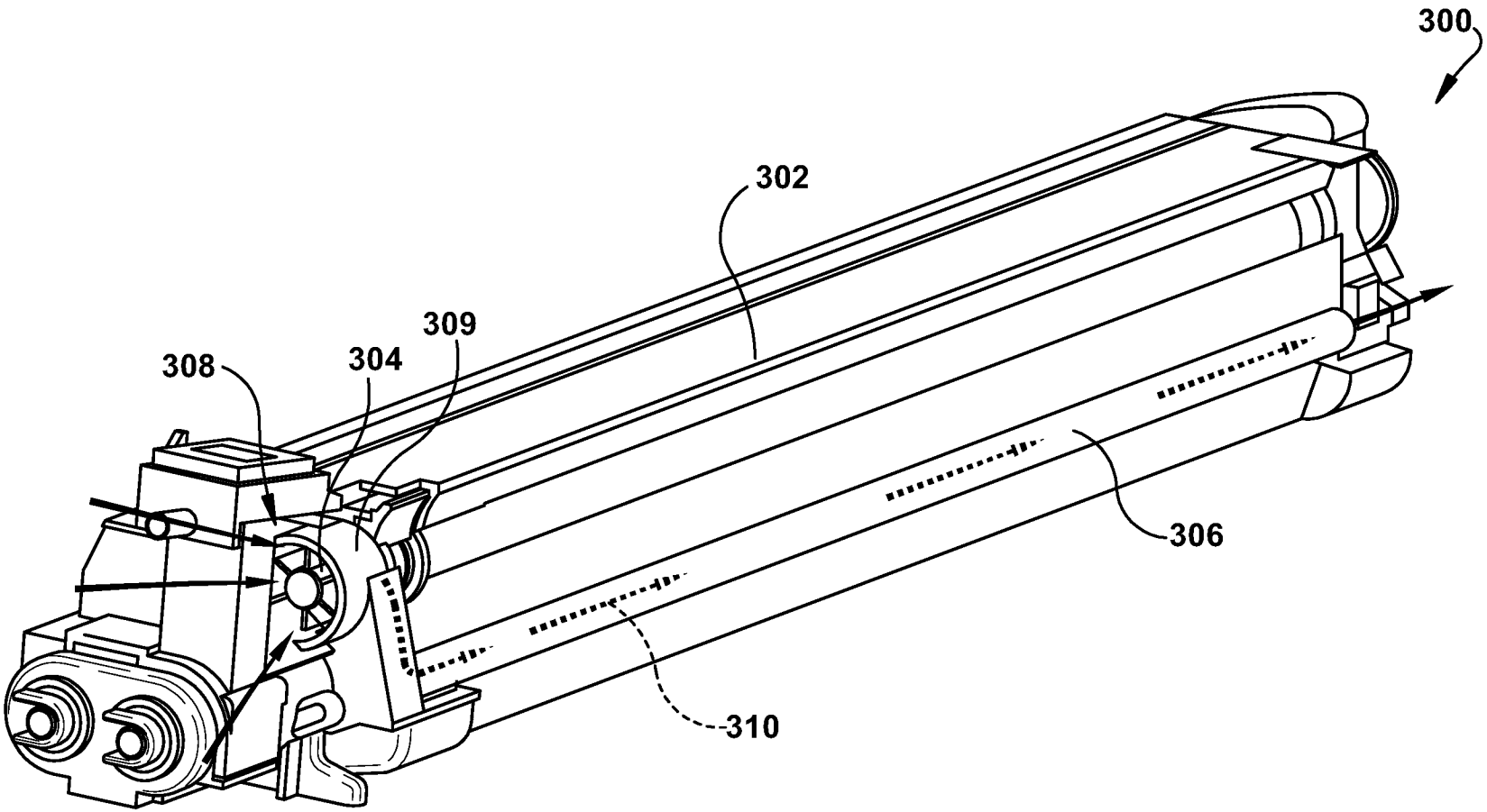
FIG. 3A is a diagram of an example electrostatic process unit with a fan and cooling duct.
Figure 3B:
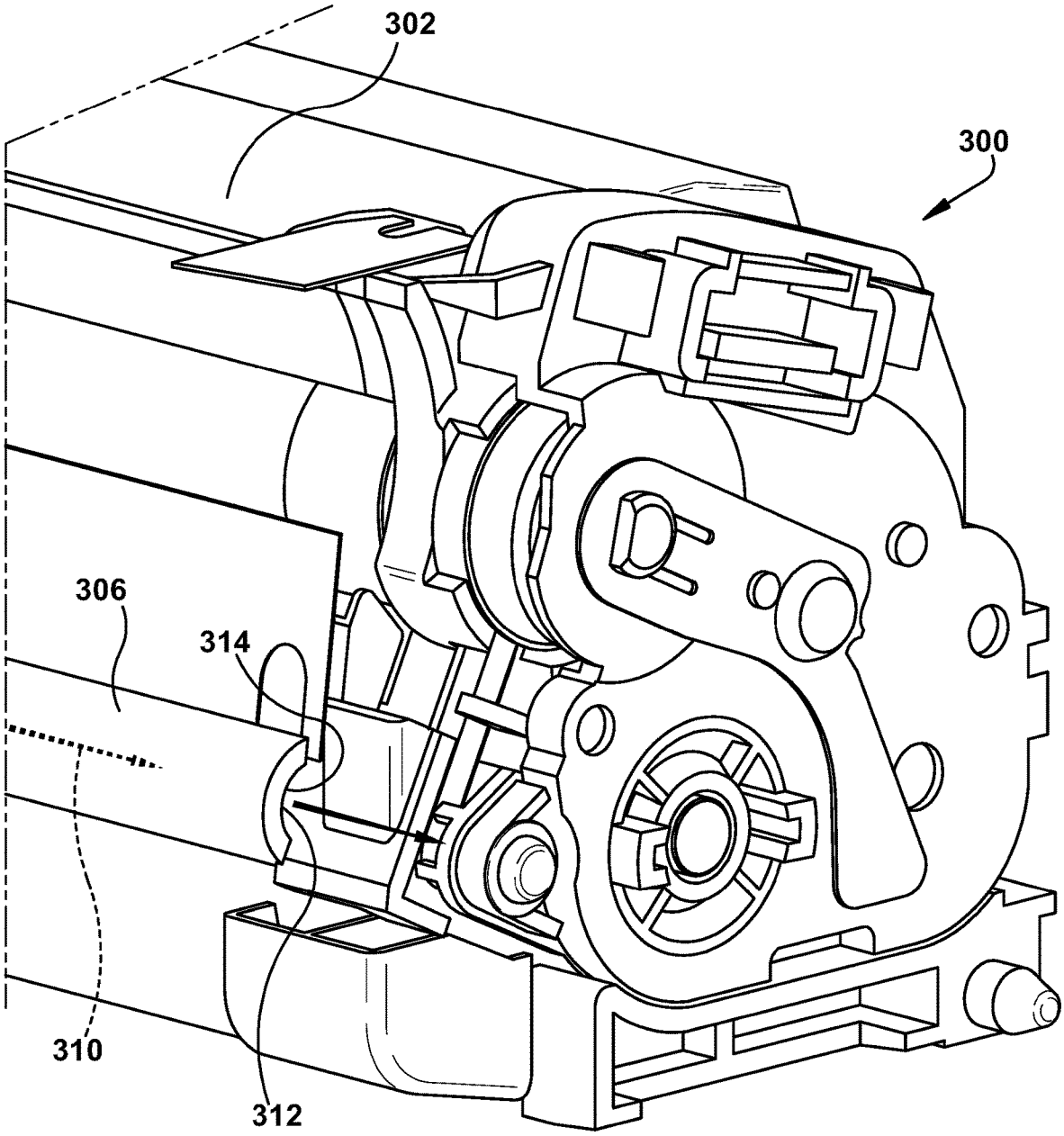
FIG. 3B is a partial view of the cooling duct and electrostatic process unit of FIG. 3A.

With reference to FIGS. 3A and 3B, an example fan-cooled electrostatic process unit 300 is presented. The electrostatic process unit 302 includes a fan impeller 304, or fan, that is in communication with a shaft of a rotatable component of the electrostatic process unit 302. In the illustration, the fan impeller 304 is shown as directly connected to the shaft of the developer. In various different embodiments, the fan impeller 304 can be suitably connected to any of the shafts of rotatable component of the electrostatic process unit 302. For example, the fan impeller 304 can be connected to a shaft by a direct connection, by gearing, or by any other suitable means as would be understood in the art. The rotatable component is to be interpreted broadly to include any rotating component of the electrostatic process unit 302 including the toner mixer, the developer roller, the photoconductive drum, the waste toner auger, or any other rotatable member of the electrostatic process unit 302 as would be understood in the art.

When the associated shaft turns, the fan impeller 304 turns and draws air through an inlet 308 in a shroud 309 that partially surrounds the fan impeller 304. The shroud 309 can be separate or part of the cover of the developer or any other component of the electrostatic process unit 302. When turned, the fan impeller 304 pushes air into the cooling duct 306. The cooling duct 306 receives air from the fan impeller 304 and directs the airflow 310 to the components of the electrostatic process unit 302 to be cooled.

The cooling duct 306 can be shaped in any suitable configuration and can be closed or partially open. For example, in certain embodiments the cooling duct 306 can be a closed tube constructed of a heat conductive material such as copper. In these embodiments, the cooling duct 306 can be in direct contact with a component that is cooled by conduction through the walls of the closed tube. For example, the cooling duct 306 can be a closed tube that passes through the interior of the electrostatic process unit 302, where toner may be present, to contact the components to be cooled. A closed tube advantageously would prevent stray toner from escaping or mixing with the airflow 310. In certain other embodiments, the cooling duct 306 can be partially open and operates by directing the airflow 310 across an exterior surface of one of the components which cools the component by convection. For example, as illustrated in the partial view of FIG. 3B, the cooling duct 306 can direct the airflow 310 along the length of the doctor blade 314 to cool the doctor blade 314 and the developer at the doctor blade/developer interface. An exhaust duct 312 then directs the heated airflow 310 away from the electrostatic process unit 302. In various embodiments, multiple cooling ducts 306 can be used to direct airflows 310 around the electrostatic process unit 302 to cool desired components.

Advantageously, the fan impeller 304 and cooling duct 306 provide a simple, low-cost solution for cooling desired components of the electrostatic process unit 302 without requiring separate fans and motors. By comparison, adding separate fans and motors would not only take up valuable space inside the printer, but would also require control by a suitable motor controller, thereby increasing both cost and complexity. Advantageously, the disclosed fan impeller 304 and cooling duct 306 can allow existing electrostatic process units 302 to be retrofitted to include the fan impeller 304 and cooling duct 306. Advantageously, the disclosed fan impeller 304 and cooling duct 306 can be configured to substantially conform to the footprint of existing electrostatic process units 302 in the field, thereby allowing existing electrostatic process units 302 to be replaced with electrostatic process units 302 that include the fan impeller 304 and cooling duct 306.

Figure 4:
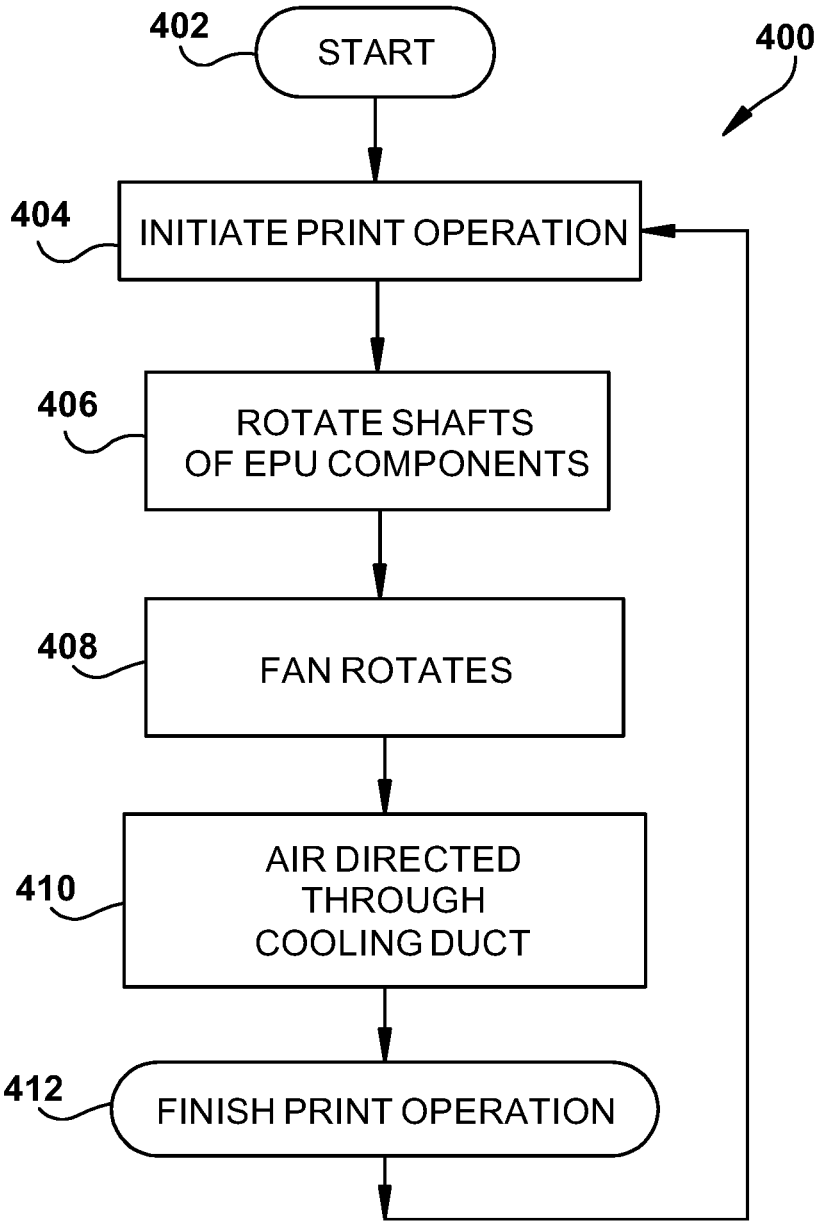
FIG. 4 is a flowchart of example operations of a fan and cooling duct for cooling an electrostatic process unit of a toner-based printer.

With reference to FIG. 4, an example flowchart 400 of operations for cooling components of an EPU of a toner-based printer is presented. Processing commences at start block 402 and proceeds to process block 404.

At process block 404, a print operation is initiated on the printer, for example in response to receiving a print request from a user to print a document. Processing continues to process block 406.

At process block 406, in response to initiating the print operation, certain components of the EPU rotate in a coordinated fashion as describe in detail above, including the toner mixers, the photoconductive drum, the developer roller, and the waste toner auger. Processing continues to process block 408.

At process block 408, as the shafts rotate a fan impeller suitably connected to one of the shafts also rotates. The fan impeller can be pressed onto the shaft or suitably connected via gearing or other means as would be understood in the art. As the fan impeller turns, air is drawn through an inlet by the fan impeller and directed into a cooling duct. Processing continues to process block 410.

At process block 410, the cooling duct receives the air from the fan impeller and directs the air through the cooling duct. As air passes through the cooling duct it cools nearby components of the EPU. The cooling duct can be shaped in any suitable configuration and can be closed or partially open. In certain configurations the cooling duct can direct air through the interior of the EPU, for example through a closed tube. The closed tube may be constructed of a heat conductive material such as copper. The closed tube may be in contact with one or more components in the interior of the EPU. In other configurations the cooling duct can be a partially open tube that directs air across the surface of a component, for example by directing air across the outside of a component. Processing continues to process block 412.

At process block 412, the print operation is completed, and the EPU performs any necessary operations to configure the components for the next print job. Processing then returns to process block 404 where the next print job is received and the cycle is repeated. Processing can terminate at any suitable block, for example when the printer finishes a print job, when the printer enters a sleep or idle mode, or when the printer is turned off.

In light of the foregoing, it should be appreciated that the present disclosure significantly advances the art of cooling electrostatic process units. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a fan impeller configured to be coupled to a shaft associated with a rotatable component of an electrostatic process unit (EPU);

a cooling duct in fluidic communication with the fan impeller and configured to direct air from the fan impeller across at least a portion of the EPU; and a shroud configured to couple air from an inlet across the fan impeller and into the cooling duct.

2. The apparatus of claim 1, wherein the fan impeller is configured to force air into the cooling duct when the shaft is rotated during a print operation.

3. The apparatus of claim 1, wherein the fan impeller is coaxially attached to the shaft and configured to rotate with the shaft when the shaft is rotated.

4. The apparatus of claim 1, wherein the rotatable component associated with the shaft is selected from the group consisting of a developer roller, a photoconductive drum, a toner auger, and a waste auger.

5. The apparatus of claim 1, wherein the cooling duct is configured to direct air substantially across a doctor blade of the EPU.

6. The apparatus of claim 1, wherein the cooling duct is at least partially open across the portion of the EPU.

7. The apparatus of claim 6, wherein the cooling duct includes an exhaust port configured to substantially direct heated air away from the EPU.

8. The apparatus of claim 1, further comprising:

an EPU configured with the fan impeller and the cooling duct; and a multifunction peripheral configured to accept the EPU.

9. An electrostatic process unit, comprising:

one or more rotatable mixers configured to stir toner;

a rotatable developer roller configured to attract at least some of the toner stirred by the one or more rotatable mixers;

a rotatable photoconductive drum configured to selectively attract toner from the developer roller and deposit the selectively attracted toner onto a paper or a transfer belt;

a waste auger configured to remove waste toner from the electrostatic process unit;

a fan impeller configured to direct air into an associated cooling duct when the fan impeller is rotated;

a cooling duct in fluidic communication with the fan impeller and configured to direct air from the fan impeller across at least a portion of the electrostatic process unit; and a shroud configured to couple air from an inlet across the fan impeller and into the cooling duct, wherein each of the rotatable mixers, the rotatable developer roller, the rotatable photoconductive drum, and the waste auger comprises a shaft, and wherein the fan impeller is coupled to at least one of the shafts.

10. The electrostatic process unit of claim 9, wherein the fan impeller is configured to force air into the cooling duct when the shaft is rotated during a print operation.

11. The electrostatic process unit of claim 9, wherein the fan impeller is coaxially attached to the shaft and configured to rotate when the shaft is rotated.

12. The electrostatic process unit of claim 9, wherein the at least one shaft is associated with the developer roller, and wherein the shroud is associated with a housing of the developer roller.

13. The electrostatic process unit of claim 9, wherein the cooling duct is configured to direct air substantially across a doctor blade of the electrostatic process unit.

14. The electrostatic process unit of claim 9, further comprising:

a multifunction peripheral configured to accept the electrostatic process unit.

15. A method, comprising:

initiating a print operation on a print engine;

rotating, in response to the print operation, at least one shaft associated with a rotatable component of an electrostatic process unit (EPU) of the print engine, the at least one shaft configured to rotate a fan impeller;

impelling air from an inlet across the fan impeller by the rotating fan impeller into a cooling duct that is in fluidic communication with the fan impeller via a shroud;

cooling, by the air in the associated cooling duct, at least one component of the EPU.

16. The method of claim 15, wherein the at least one component of the EPU cooled by the air is one or more of the developer or a doctor blade.

17. The method of claim 15, wherein the rotatable component of the EPU is selected from the group consisting of a toner mixer, a waste auger, a developer, and a photoconductive drum.

18. The method of claim 15, wherein the print engine is a print engine of a multifunction peripheral.

* * * * *